US010011907B2

(12) United States Patent
Roth et al.

(10) Patent No.: US 10,011,907 B2
(45) Date of Patent: Jul. 3, 2018

(54) METHOD FOR THE MANUFACTURE OF A SUBSTRATE PROVIDED WITH A CHROMIUM VI-FREE AND COBALT-FREE PASSIVATION

(71) Applicant: Ewald Doerken AG, Herdecke (DE)

(72) Inventors: Marcel Roth, Duesseldorf (DE); Christopher Koester, Herdecke (DE); Ingo Klueppel, Bochum (DE); Verena Grossmann, Herdecke (DE); Gerhard Reussmann, Essen (DE)

(73) Assignee: Ewald Doerken AG, Herdecke (DE)

( * ) Notice: Subject to any disclaimer, the term of this patent is extended or adjusted under 35 U.S.C. 154(b) by 479 days.

(21) Appl. No.: 14/621,434

(22) Filed: Feb. 13, 2015

(65) Prior Publication Data

US 2015/0225856 A1 Aug. 13, 2015

(30) Foreign Application Priority Data

Feb. 13, 2014 (EP) ..... 14155058

(51) Int. Cl.

| | |
|---|---|
| ***C23C 22/73*** | (2006.01) |
| ***C23C 22/07*** | (2006.01) |
| ***C23C 22/36*** | (2006.01) |
| ***C23C 22/42*** | (2006.01) |
| ***C23C 22/44*** | (2006.01) |
| ***C23C 22/60*** | (2006.01) |
| ***C23C 22/80*** | (2006.01) |
| ***C23C 22/34*** | (2006.01) |
| ***C23C 22/46*** | (2006.01) |
| ***C23C 22/83*** | (2006.01) |

(52) U.S. Cl.

CPC ..... *C23C 22/73* (2013.01); *C23C 22/07* (2013.01); *C23C 22/34* (2013.01); *C23C 22/36* (2013.01); *C23C 22/42* (2013.01); *C23C 22/44* (2013.01); *C23C 22/46* (2013.01); *C23C 22/60* (2013.01); *C23C 22/80* (2013.01); *C23C 22/83* (2013.01); *C23C 2222/10* (2013.01); *C23C 2222/20* (2013.01); *Y10T 428/265* (2015.01); *Y10T 428/31663* (2015.04)

(58) Field of Classification Search

None

See application file for complete search history.

(56) References Cited

U.S. PATENT DOCUMENTS

| | | | | |
|---|---|---|---|---|
| 3,989,550 | A | 11/1976 | Newhard | |
| 4,424,559 | A | 1/1984 | Lorincz et al. | |
| 4,466,832 | A | 8/1984 | Yoshimura et al. | |
| 4,578,122 | A | 3/1986 | Crotty | |
| 5,415,688 | A | 5/1995 | Gasmena et al. | |
| 5,433,976 | A * | 7/1995 | van Ooij | B05D 7/16 427/327 |
| 6,478,886 | B1 | 11/2002 | Kunz et al. | |
| 2006/0054248 | A1 * | 3/2006 | Straus | C23C 22/47 148/256 |
| 2010/0209719 | A1 | 8/2010 | Borup et al. | |
| 2011/0155286 | A1 | 6/2011 | Sugiura et al. | |
| 2011/0283916 | A1 | 11/2011 | Bohlander | |
| 2013/0295292 | A1 | 11/2013 | Bukeikhanova et al. | |

FOREIGN PATENT DOCUMENTS

| | | | | |
|---|---|---|---|---|
| DE | 32 13 384 | | 12/1982 | |
| DE | 198 14 605 | | 10/1999 | |
| DE | 102 61 014 | | 7/2004 | |
| DE | 102007045186 | | 4/2009 | |
| DE | 10 2011 085 230 | | 5/2012 | |
| DE | 10 2011 013 319 | | 9/2012 | |
| DE | 10 2011 111 757 | | 2/2013 | |
| EP | 0 839 931 | | 5/1998 | |
| EP | 1433879 | | 6/2004 | |
| EP | 2 492 371 | | 8/2012 | |
| GB | 2 097 024 | | 10/1982 | |
| GB | 2097024 | A * | 10/1982 | C23C 22/34 |
| KR | 1020040103565 | | 12/2004 | |
| KR | 1020050059816 | | 6/2005 | |
| KR | 100979010 | | 8/2010 | |
| WO | 95/24517 | | 9/1995 | |
| WO | 2009/132102 | | 10/2009 | |
| WO | 2011/147447 | | 12/2011 | |

OTHER PUBLICATIONS

European Apln No. 14155058.2-1362 search report dated Dec. 22, 2014.

* cited by examiner

*Primary Examiner* — Michael P Rodriguez

(74) *Attorney, Agent, or Firm* — Bachman & LaPointe, PC

(57) ABSTRACT

A method for the manufacture of a substrate provided with a chromium VI-free and a cobalt-free passivation by the application of a first acidic passivation and a second alkaline passivation, containing a silane-modified and/or a siloxane modified silicate, with which an improved protection against corrosion is achieved, an aqueous, acidic composition for passivating and a passivated substrate, and a device for applying the passivation.

19 Claims, No Drawings

METHOD FOR THE MANUFACTURE OF A SUBSTRATE PROVIDED WITH A CHROMIUM VI-FREE AND COBALT-FREE PASSIVATION

BACKGROUND OF THE INVENTION

The invention relates to a method for the manufacture of a substrate provided with a chromium VI-free and a cobalt-free passivation, the substrate provided with such a passivation as well as a device for carrying out the method and an aqueous, acidic composition for passivating which is suitable for use in the aforementioned method.

The passivation of metallic substrates has proven its worth; however, the components of the passivation solutions have turned out to be a risk from a health and an environmental protection point of view. Thus chromium (VI) compounds frequently can no longer be used and also elements, such as cobalt and nickel, frequently are no longer desirable.

A chromium (VI)-free and cobalt-free composition for passivating is disclosed in U.S. Pat. No. 4,578,122. Nitrate ions and chromium (III) compounds in an aqueous, acidic solution are used, additionally activating metal ions, such as iron, aluminum, lanthanum or cerium ions being added. The ratio of nitrate ions on the one hand to chromium (III) ions and activating metal ions on the other should not be less than 4:1.

In the future, the addition of the activating metal ions, indicated in U.S. Pat. No. 4,578,122, either is no longer desirable for reasons of health or the environment or the use of metal ions is expensive.

Published patent application DE 3 213 384 discloses a first acidic and a second alkaline passivation which is free of chromium VI and cobalt. However, this two-step passivation is not yet optimized with regard to corrosion protection.

SUMMARY OF THE INVENTION

It is therefore the object of the invention to provide a method for passivating metallic substrates, which produces good corrosion protection and avoids unnecessary risks to health and the environment. Furthermore, it is the object to propose a composition and a device for passivating metallic substrates which are suitable for carrying out the method.

The object, on which the invention is based, is accomplished by a method, an aqueous solution, a substrate, and a device as disclosed herein.

DETAILED DESCRIPTION

For the manufacture of a metallic substrate, which is provided with a chromium VI-free and cobalt-free passivation in accordance with the inventive method, a first acidic and a second alkaline passivation is applied, an aqueous, alkaline composition which is used for the manufacture of the second alkaline passivation containing silane-modified silicates, said silane-modified silicates comprising preferably silanes which are chemically bound to silicates. The combination of the two passivations, acidic and alkaline, brings about good corrosion protection.

The first acidic and the second alkaline passivation are applied as aqueous compositions, the constitution of which will be explained in the following. The concept of passivation is used in conjunction with this invention for the aqueous composition for passivating the substrate or respectively for the application of the aqueous compositions as well as for the coating applied on the surface of the metallic work piece. Treating the surface of the metallic substrate with the acidic and alkaline aqueous compositions leads to the deposition of chemical components which are contained therein and which form a coating on the surface of the substrate, that is, form the passivation. The coating or respectively coatings bring(s) about improved protection against corrosion.

The first acidic passivation may have any composition; however, in accordance with the invention, the composition preferably is free of chromium VI and cobalt. Preferably, it is also free of nickel. A particularly preferred composition for the first, acidic passivation is described further below.

The substrate or work piece coated with a first, acidic passivation is coated with a second passivation according to the invention, the second passivation being an alkaline passivation. The protection against corrosion is clearly increased by the second, alkaline passivation. Work pieces, for which the acidic passivation does not contain any vanadium or tungsten, become significantly more resistant to corrosion by a second, alkaline passivation which is applied on the first acidic passivation. In particular, the protection against corrosion is, however, improved if the first, acidic passivation is produced using an aqueous, acidic composition which contains vanadium and/or tungsten or the compounds thereof.

The application of a silicate-containing aqueous composition as the second, alkaline passivation for coating the first acidic passivation is a significant feature of the invention. In this way, a silicate compound is applied on the first acidic passivation. Typical silicate compounds are water glasses; however, aqueous polysilicates or colloidal silicates are also very suitable for the second, alkaline passivation. Preferably, the second alkaline passivation has sodium, potassium, lithium and/or ammonium silicate. A second, alkaline passivation, which has a mixture of silicate compounds, may also be applied on the work piece. Colloidal silicates, as well as dissolved silicates may be used. Silane-modified or siloxane-modified silicates, for which the silanes or siloxanes are linked to the silicates, preferably polysilicates, have also proven to be very suitable for the implementation of the invention. In the presence of water, most silicates form alkaline solutions or suspensions. If required, however, the alkalinity can be increased by the addition of caustic solutions, such as caustic soda solutions.

The use of lithium polysilicate in the aqueous composition for passivating metallic substrates has proven to be particularly advantageous for producing the second alkaline passivation. The application of an aqueous composition of lithium polysilicate or the mixture of lithium polysilicate with other water glasses (sodium and/or potassium silicate) or colloidal silica sols on the first acidic passivation brings about an exceptionally improved corrosion protection. At the same time, when lithium polysilicate is used to produce the second alkaline passivation, the formation of grayish haze on the surface of the metallic substrate being passivated according to the invention is avoided, which is customary for passivation from aqueous compositions of sodium or potassium water glasses.

In accordance with the invention, the aqueous, alkaline composition, which is used for the second alkaline passivation, comprises a silane or a siloxane. The addition of the silane or siloxane increases the corrosion protection further. Preferably, a vinyl silane and/or amino silane are/is used to produce the second alkaline passivation; however, epoxysilanes and the siloxanes of the silanes named above and below are also suitable. In particular, alkyl alkoxy silanes, here: mono-, di- or trialkyl alkoxy silanes, individually or in mixtures in combination with silicates, are suitable for building up a corrosion-resistant coating on the metallic work piece which has already been treated with an acidic aqueous composition. A mixture of different silane compounds may be used. Methacryloxy methyltriethoxy silane, 3-aminopropyl methyldiethoxy silane, 3-aminopropyl triethoxy silane, N-(2-aminoethyl)3-aminopropyl methyldimethoxy silane, 3-glycidyloxy propyltrimethoxy silane, vinyl trimethoxy silane, vinyl triethoxy silane, methyl trimethoxy silane, ethyl trimethoxy silane and 3-mercaptopropyl trimethoxy silane are particularly suitable silane compounds. The silane is preferably bound chemically to the silicate.

Based on the total amount of the aqueous composition of the second alkaline passivation, silane or siloxane may be used in an amount of 1% by weight up to 99% by weight. However, aqueous compositions, which have only small amounts of silane, such as up to 20% by weight, already exhibit a clearly improved corrosion protection.

According to the invention, an aqueous, alkaline composition is used for the manufacture of the second alkaline passivation, which contains silicates as well as silanes and/or siloxanes or mixtures of silicates and silanes or respectively siloxanes or respectively compounds of a silicate component and a silane component, in the following: silane-modified silicates or compounds from a silicate and a siloxane component, in the following: siloxane-modified silicates. The silanes or respectively siloxanes are linked here typically for example by hydrolysis as covalent side chains to the silicate or silicates. These silane-modified or siloxane-modified silicates produce excellent corrosion protection on a first, acidic passivation; this corrosion protection far exceeds the effect of a simple acidic or alkaline passivation. The silane-modified or siloxane-modified silicates can be detected by NMR spectroscopy on the metallic substrate. In particular, silicon-carbon bonds (SiC bonds) can be detected. At the same time, the second alkaline passivation forms an excellent base for further coatings, such as coloring coatings or coatings which contain a lubricant or other additives, which further improve the use of the coated surface. If silane-modified silicates are mentioned or described in conjunction with this invention, the use of siloxane-modified silicates is always also meant and included.

According to a further preferred embodiment of the invention, the second alkaline passivation may be produced from a partly or, preferably, from completely hydrolyzed silicate and silane or respectively siloxane compounds. On the one hand, due to the joint hydrolysis of silicates and silanes or respectively siloxanes in aqueous solution, silane-modified or respectively siloxane-modified silicates are formed. On the other, alcohols which are released by the hydrolysis in the factory can be removed, so that aqueous, alkaline compositions, which have a low content of or are free of volatile organic compounds (VOC), can be made available to the users. The alcohols set free by hydrolysis can be removed, for example, by ultramembrane filtration or reverse osmosis, but also by distillation, for example, by vacuum distillation. Typical, inventive aqueous alkaline compositions for passivating metallic substrates contain no more than 1% by weight of alcohol and preferably no more than 0.3% by weight of alcohol.

If desired, it is readily possible to add additives to the aqueous composition for the second alkaline passivation. As a rule, the additives are already added to the liquid composition, from which the second alkaline passivation is produced. They develop their action either, as, for example, in the case of defoamers or stabilizers, during the application or, for example, in the case of lubricants or dyes, after the application and optionally the drying of the second alkaline passivation.

According to an advantageous embodiment of the invention, which is to be regarded as an independent technical solution, it is proposed for the manufacture of the first, acidic passivation of the metallic substrate that an aqueous, acidic cobalt-free and chromium (VI)-free composition be used, which contains a chromium (III) compound, an inorganic acid and optionally a source of fluorine and which is characterized in that the aqueous composition contains a compound of the metals vanadium or tungsten, wherein this metal compound can in each case be used individually or in a mixture with other vanadium or tungsten compounds.

In conjunction with the aforementioned, already known components of the first acidic passivation, molybdenum, vanadium and tungsten compounds already bring about excellent protection against corrosion, the inventive composition appreciably reducing the risk of damage to health and the environment during the handling of the aqueous composition, for example, during the coating, but also as a finished, applied passivation and, as a result, can be used with high operational safety. Molybdenum, vanadium and tungsten compounds are incorporated in the first acidic passivation and impart improved protection against corrosion there.

The inventive, aqueous, acidic and alkaline compositions for passivating metallic substrates generally are suitable for all metallic surfaces or respectively substrates, but especially for work pieces with a surface of steel, iron, aluminum, or zinc, particularly however, also for work pieces the surface of which has been provided with an alloy of one or both of the metals aluminum and zinc with further metals. Typically, for example, a zinc-aluminum alloy, an aluminum alloy or a zinc alloy with further metals such as iron or magnesium, for example, with a zinc-iron alloy, all of which can be provided with a coating to protect against corrosion, are suitable. The thickness of the applied coating of metal or alloy is between 5 μm and 100 μm. The metal alloy is applied as a discrete layer on a substrate. Coil coating, that is, the passivation of steel strip, is a typical application.

Advantageously, compounds of the metals molybdenum, vanadium and/or tungsten with oxygen in the aqueous, acidic composition are used for passivation. Preferably, one or more of the compounds listed in the following are used in the aqueous, acidic composition: potassium orthovanadate, potassium metavanadate, sodium orthovanadate, sodium metavanadate, sodium tungstate, sodium paratungstate and vanadium pentoxide as well as sodium molybdate and potassium molybdate. According to the invention, compounds of the metals molybdenum, vanadium and/or tungsten, are used, which disassociate in the aqueous, acidic composition for passivation and, in so doing, release molybdenum, vanadium and/or tungsten anions. Molybdenum, vanadium and tungsten ions are incorporated into the passivation layer and cause very good corrosion protection to be built up already in the acidic passivation alone.

In accordance with a preferred alternative composition for passivating metallic substrate, a phosphonic acid or a mixture of phosphonic acids are used as complexing agent. Especially preferred is the use of organic phosphonic acids, such as (1-hydroxyethane-1,1-diyl)biphosphonic acid, 2-phosphonobutanel 1,2,4-tricarboxylic acid, aminotrimethylene phosphonic acid, ethylene diamine tetramethylene phosphonic acid or diethylene triamine pentamethylene phosphonic acid or mixtures thereof. The use of salts of phosphonic acid may also prove to be advantageous in connection with the invention. Particularly suitable are the phosphonates which are listed in the following and used individually or also in a mixture: tetrasodium(1-hydroxyethane-1,1-diyl)biphosphonate, trisodium(1-hydroxy-ethane-1,1-diyl)biphosphonate, pentasodium ethylenediamine tetramethylene phosphonate or heptasodium diethylenetriamine pentamethylene phosphonate. The salts dissociate in the aqueous, acidic passivating composition, so that the phosphonate are available as complexing agents. Furthermore, phosphonic acids and the derivatives thereof may advantageously also be used in conjunction with vanadium and tungsten compounds in acidic, aqueous compositions. The use of phosphonic acid as a complexing agent has proven its value here.

Within the scope of the inventive method, the acidic, aqueous compositions for passivating metallic substrates preferably contain one or more elements or compounds of the group comprising molybdenum, manganese, cerium and lanthanum. A further improvement in the anticorrosive properties of the inventive passivation is attained by the addition of these elements or the compounds thereof and, preferably, of the salts and oxides thereof.

According to a preferred embodiment, the aqueous, acidic composition for passivation contains a chromium (III) compound or a mixture of chromium (III) compounds which is selected from the group comprising chromium (III) sulfate, chromium (III) hydroxide, chromium (III) dihydrogen phosphate, chromium (III) chloride, chromium (III) nitrate, sodium chromium (III) sulfate, potassium chromium (III) sulfate and chromium (III) salts of organic acids. It has turned out that an aqueous, acidic composition for passivation has good corrosion protection properties even without the use of a chromium (VI) compound. The chromium (III) compound is used in an amount of at least 0.05 g/L up to saturation. If the amount is less than 0.005 g/L, the corrosion protection built up is inadequate. For economic reasons, exceeding saturation is not reasonable.

It has furthermore proven to be advantageous to add a nitrate compound or a mixture of nitrate compounds to the aqueous, acidic composition for passivating. In this connection, preferably nitrogen-containing acids, such as nitric acid, as well as salts of these acids are used. Typical salts, which are particularly suitable for use in the passivating composition, are salts of the alkali metals, ammonium salts or salts of the metal ions contained in the passivating composition, for example chromium (III) nitrate. The above-described nitrogen compounds and chromium (III) compounds essentially are present in the dissociated form in the aqueous, acidic passivating composition. The amount of nitrate compounds preferably is 5% by weight to 20% by weight, based on the total composition which is used for the passivation.

Also advantageous is the use of an aqueous, acidic composition, which is free of cobalt and chromium (VI), for passivating metallic substrates, and which contains a chromium (III) compound, an acid, metal ions, nitrate ions and optionally a source of fluorine as well as a phosphonic acid and/or the derivatives thereof and which is characterized in that nitrate ions are used in a ratio of not more than 3:1 and preferably of not more than 1:3 to the sum of the chromium and metal ions. For the use of this aqueous, acidic composition for passivating, the reduced use of nitrate proved to be advantageous because fewer nitro gases are released.

For the reliable application of the coating and the building up of good corrosion protection, it is, however, advisable that the acidic, aqueous composition for passivating is adjusted to a pH of less than 4 and preferably to a pH of less than 3. In order to ensure this, an acid or a mixture of acids is added. The use of organic and/or inorganic acids, typically of one or more of the acids of the group comprising phosphoric acid, hydrochloric acid, nitric acid and/or sulfuric acid, as inorganic acids and formic acid, succinic acid, acetic acid, oxalic acid, peracetic acid, salicylic acid and citric acid as organic acids, has proven to be particularly advantageous. The organic acids alone do not always ensure that the desired pH is reached. Nevertheless, the use thereof has proven to be appropriate because the organic acids additionally act as complexing agents in the acidic, aqueous composition.

In order to achieve good adhesion of the passivation, the aqueous, acidic composition preferably has a source of fluorine. Preferably, such a source of fluorine is a compound or a mixture of compounds selected from the group comprising hydrofluoric acid, hexafluoro titanic acid, hexafluoro zirconic acid, sodium fluoride (NaF), potassium fluoride (KF), ammonium fluoride (NH4F), sodium bifluoride (NaHF2), potassium bifluoride (KHF2) and ammonium bifluoride (NH4HF2). The fluorine compounds used as a source of fluorine are used in an amount of 0.1% by weight to 5% by weight, based on the aqueous composition. Preferably, the fluorine compounds are used as a technically pure, soluble powder.

It is noted explicitly here that elements or compounds described above, comprising vanadium, tungsten, molybdenum, manganese, cerium or lanthanum, as well as phosphonic acid and the derivatives thereof, can be used individually or in any combination. Aqueous, acidic compositions alone, which contain one or more of these elements or compounds, already bring about good protection against corrosion as acidic passivation.

The preferred aqueous, acidic composition for passivating metallic substrates is composed essentially of substances, which are largely safe from a health point of view and affect the environment hardly, if at all. It is free of cobalt, nickel, and chromium (VI) compounds. Furthermore, it is preferably also free of peroxide compounds and can be produced without using carboxylic acids. Moreover, in preferred embodiments, the use of nitrate compounds is minimized, so that the emission of nitrous gases is greatly reduced.

The aqueous, acidic composition for passivating is applied at room temperature or at a temperature not exceeding 80° C. For passivating it, the metallic substrate in most cases is dipped into a bath of the aqueous, acidic composition and subsequently of the aqueous alkaline composition. However, the compositions for passivating can also be applied by other conventional and known methods (spraying, dipping, dipping and spinning, using doctor blades, rolling) on the metallic substrate. The aqueous compositions for passivating generally are applied during a treatment lasting between 1 second and 180 seconds and preferably between about 30 seconds and 120 seconds. The application of the composition for passivating may be followed by drying, which can be carried out at temperatures between room temperature and about 250° C. The drying depends only on the removal of excess liquid; completing a reaction, such as a hydrolysis reaction or a condensation reaction of the components which form the passivating coating on the metal substrate is not required.

Optionally, before the composition is applied, the metallic substrate can be cleaned and, in particular, degreased for the passivation. Aqueous solutions for cleaning and decreasing are known from the prior art.

The first acidic passivation layer is applied at a thickness of 10 nm to 1 μm and preferably in a thickness of 20 nm to 500 nm. The second alkaline passivation layer is applied at a thickness of 10 nm to 1 μm and preferably at a thickness of 10 nm to 500 nm. These thin layers result from the adhesion of the aqueous solutions on the substrate or respectively on the prior passivation layers and a subsequent curing is not required. The thickness of the layer does not change after it is applied and dried.

The aqueous, acidic and alkaline compositions, which are required for carrying out the inventive method, preferably are supplied as concentrates, which, for use, are diluted with water in a ratio of concentrate to water of 1:5 to 1:20, and frequently of 1:10. The respective aqueous, acidic or alkaline compositions are offered in each case as one-component products.

In accordance with the invention, the outstanding corrosion protection is attained in that, to begin with, an acidic passivation and, subsequently, an alkaline passivation are applied on the metallic substrate. Correspondingly, an analysis of the finished, coated substrate shows that, starting from the substrate, initially a first passivation layer is detected, which contains chromium and nitrogen as well as optionally fluorine, vanadium and/or tungsten and, alternatively, also further metallic or rare earth elements. Usually, however, this first passivation layer does not contain any silicon or any of the elements sodium, potassium or lithium. A second passivation layer is applied on this first passivation layer. The second passivation layer accordingly is not applied directly on the metallic substrate. Typically, silicon, as well as sodium, potassium and/or lithium can be detected in the second passivation layer. Usually, however, the second passivation layer does not contain any chromium, fluorine, tungsten, vanadium of further metallic or rare earth elements. Nonmetallic elements, such as carbon, phosphorus or nitrogen, may be detected in both passivation layers.

Details of the invention are explained by means of the following exemplary embodiments:

For all the following examples, the quantitative data is given as a percentage by weight of the total composition of the respective aqueous composition which is used for producing the passivation. Unless stated otherwise, pure substances (100%) have been used. The aqueous, acidic or alkaline composition for passivating is produced by mixing or respectively dissolving the individual components.

For the acidic, aqueous composition, the water is introduced above all, for example, by the aqueous chromium (III) salt solution, here a sulfate or a nitrate, into the liquid composition for passivating. Smaller amounts are added subsequently. These compositions have a pH of 1.5 to 1.8. They can readily be stored for more than six months.

The aqueous, alkaline compositions are manufactured typically by adjusting the solids content or respectively the proportion by weight of aqueous silicates by the addition of appropriate amounts of water and, if they are to be provided, by admixing silanes. If silicates and hydrolyzed or partly hydrolyzed silanes or siloxanes are used, the hydrolysis is carried out in the factory, so that, in comparison to the not hydrolyzed products, the ready to use products have a lower alcohol content or release less alcohol during the processing.

By applying the aqueous, acidic composition for passivating by rollers at room temperature on steel sheets with a surface which consists here, for example, of a zinc-iron alloy, a passivating layer is produced on the metallic substrate. The application is accomplished by an arrangement of rollers, through which the steel sheet is passed. Subsequently, the steel sheet is rinsed in order to remove excess acidic composition. The steel sheet is then dried in a dying oven at 150° C., through which the steel sheet, provided with the first passivation, passes within a period of not more than 10 minutes. The second alkaline coating is produced in the same way.

Exemplary Embodiments of Tables 1 and 2

It is mentioned explicitly once again here that, in accordance with the invention, any acidic passivations may be applied as a first coating on a metallic substrate. The aqueous, acidic compositions, explained in greater detail here, represent only one possible embodiment of an acidic passivation. Tables 1 and 2 predominately show compositions of an aqueous, acidic composition for a first acidic passivation which contains vanadium and tungsten compounds.

Chromium (III) sulfate and chromium (III) nitrate, individually or, as in experiment ii, also together, are the main components of the composition for passivating. The proportion of chromium (III) compound in the composition for passivating is between 64.0% by weight and 77.2% by weight of the 20% solution which is used in each case.

Admittedly, a nitrate compound may also be added in the form of chromium (III) nitrate; preferably however, a nitrate salt, here sodium nitrate, is added as shown in Tables 1 and 2. The proportion of nitrate compound preferably is between 13% by weight and 16% by weight, but may also be between 5% by weight and 10% by weight.

Preferably, a fluorine salt is used as an optional source of fluorine. For the embodiments of Tables 1 and 2, sodium hydrogen difluoride is used; however, other fluorine compounds, which are named above, are also suitable.

The embodiments of the inventive composition in Tables 1 and 2 show that organic acids can be used individually or in combination. These acids act as complexing agents, but also support a low pH. However, the addition, above all, of an inorganic acid, preferably of nitric acid, is essential for adjusting the pH.

Vanadates and tungstates are added in amounts between 0.1% by weight and 5% by weight, preferably in amounts of 0.5% by weight to 3% by weight. The explanations of Tables 1 and 2 show that already small amounts of vanadate or tungstate or mixtures of vanadates and tungstates clearly increase the protective action against corrosion of a passivation composition.

The anticorrosive action of this first, acidic passivation solution is increased further, if molybdates or manganates or mixtures of molybdates and manganates are used. Amounts of 0.05% by weight up to 3% by weight of each molybdenum compound are sufficient for achieving a distinct synergistic effect in the protection against corrosion. Preferably, up to 1.5% by weight of molybdate and up to 0.5% by weight of manganate is used.

Furthermore, the addition of phosphonic acids proves to be advantageous. They act as complexing agents. The addition of individual phosphonic acids already is effective.

TABLE 1

Compositions for the acidic passivation (chromium (III) sulfate)

| | Experiment No.: | | | | |
|---|---|---|---|---|---|
| | 1 | 2 | 3 | 4 | 5 |
| Chromium (III) compound | | | | | |
| Chromium (III) sulfate (20% solution) | 77.2% | 72.7% | 72.2% | 64.0% | 70.0% |
| Nitrate compound | | | | | |
| Sodium nitrate | 9.7% | 15.8% | 15.8% | 13.5% | 13.5% |
| Fluorine compound | | | | | |
| Sodium hydrogen difluoride | 3.5% | 2.8% | 2.8% | 2.8% | 1.2% |
| Organic acid | | | | | |
| Citric acid | | | 2.5% | 2.5% | 2.5% |
| Oxalic acid | 2.5% | 2.5% | | | |
| Inorganic acid | | | | | |
| Nitric acid $HNO_3$ | 3.1% | 2.2% | 2.2% | 2.2% | 2.2% |
| Vanadium or tungsten compound | | | | | |
| Sodium vanadate | | 1.5% | 1.5% | | |
| Potassium vanadate | | | | | |
| Vanadyl sulfate | | | | 15.0% | |
| Sodium tungstate | | | | | |
| Sodium molybdate | | | 0.5% | | |
| Potassium molybdate | | | | | |
| Phosphonic acid | | | | | |
| 1-Hydroxyethane-1,1-diphosphonic acid | | | | | 1.5% |
| Water | 4.0% | 2.5% | 2.5% | | 9.1% |
| Total | 100.0% | 100.0% | 100.0% | 100.0% | 100.0% |

The use of nitric acid is preferred only because it can be regarded as an additional source of nitrate ions. The pH can also be adjusted to the preferable value of less than 4 with, for example, sulfuric acid, hydrochloric acid or phosphoric acid; mixtures of inorganic and/or organic acids can be used as well (see experiments 11 and 12 in Table 2).

Small amounts of up to 5% by weight of inorganic acids usually are sufficient in order to adjust the pH to a value of less than 4.

However, the addition of mixtures of different phosphonic acids also shows good results. Phosphonic acids are added in amounts of 0.01% by weight to 5% by weight and preferably in amounts of 0.5% by weight to 3% by weight. It is noted explicitly once again here that the use of elements or compounds, such as vanadium, tungsten, molybdenum, manganese, cerium or lanthanum, as well as of phosphonic acid and the derivatives thereof, in each case individually or in any combination, ensures good corrosion protection properties already in the case of a first, acidic passivation.

TABLE 2

Composition for an acidic passivation (chromium (III) nitrate and sulfate)

| | Experiment No.: | | | | | | |
|---|---|---|---|---|---|---|---|
| | 6 Amount | 7 Amount | 8 Amount | 9 Amount | 10 Amount | 11 Amount | 12 Amount |
| Chromium (III) compound | | | | | | | |
| Chromium (III) sulfate solution (20%) | | | | | | 5.0% | 70.0% |
| Chromium (III) nitrate solution (20%) | 65.7% | 65.7% | 65.7% | 65.7% | 65.7% | 65.7% | |
| Nitrate compound | | | | | | | |
| Sodium nitrate | 15.8% | 15.8% | 15.8% | 15.8% | 15.8% | 15.8% | 15.8% |
| Fluorine compound | | | | | | | |
| Sodium hydrogen difluoride | 0.2% | 0.2% | 0.2% | 1.7% | 1.7% | 1.7% | 1.7% |
| Organic acid | | | | | | | |
| Citric acid | 1.0% | | 1.0% | 2.5% | 2.5% | 0.1% | 0.1% |
| Oxalic acid | | 2.5% | | | | | |
| Salicylic acid | | 2.5% | | | | | |
| Succinic acid | 1.0% | | 1.0% | 1.0% | 1.0% | 1.0% | 1.0% |
| Inorganic acid | | | | | | | |
| Nitric acid $HNO_3$ | 2.2% | 2.2% | 2.2% | 2.2% | 2.2% | 1.2% | 1.2% |
| Sulfuric acid | | | | | | 1.5% | 1.5% |
| Vanadium or tungsten compound | | | | | | | |
| Sodium vanadate | | | | | | | |
| Potassium vanadate | | | | 1.5% | | | |
| Vanadyl sulfate | | | 1.3% | 1.3% | | | |
| Sodium tungstate | 1.0% | | 1.0% | 1.0% | | | |
| Sodium molybdate | | | | | 1.0% | 1.0% | 1.0% |
| Potassium molybdate | | | | | 0.5% | 0.5% | 0.5% |
| Phosphonic acid | | | | | | | |
| 1-Hydroxyethane 1,1-diphosphonic acid | 1.0% | | | | | 1.0% | 1.0% |
| Amino tris(methylene phosphonic acid) | | | | | | | |
| Ethylenediamine tetra (methylene phosphonic acid) | 1.0% | | 0.7% | | | | |
| Diethylentriamine penta (methylene phosphonic acid) | | | | | 1.5% | 1.0% | 1.0% |
| Hexamethylene diamine tetra-(methylene phosphonic acid) | | | | | | | |
| Hydroxyethylamino di-(methylene phosphonic acid) | | | | | 0.5% | 0.5% | 0.5% |
| 2-Phosphonobutane-1,2,4-tricarboxylic acid | | | | | | 0.5% | 0.5% |
| Bis(hexamethylenetriamine penta-(methylene phosphonic acid)) | | | | | 0.2% | 0.2% | 0.2% |
| Sodium permanganate | | | | | 0.1% | 0.1% | 0.1% |
| Water | 11.1% | 11.1% | 11.1% | 7.3% | 7.3% | 3.2% | 3.9% |
| Total | 100.0 | 100.0% | 100.0% | 100.0% | 100.0% | 100.0% | 100.0% |

The first, acidic passivation is applied on steel sheets which have a surface of a zinc-iron alloy, may have been pretreated in a known manner and, in particular, for example, may have been cleaned and degreased.

Exemplary Embodiments of Tables 3 and 4

A second, alkaline passivation is applied in accordance with the invention on the dried, first acidic passivation, which was applied from an aqueous, acidic composition onto the steel sheet with the surface of an iron-zinc alloy. In this case, the aqueous, alkaline compositions for producing a second, alkaline passivation, which will be described in greater detail in the following, are applied on the first acidic passivation of exemplary embodiments 1 and 2.

This second passivation is applied as an aqueous composition. The aqueous coating composition is alkaline. The pH of more than 9 and preferably of between 10 and 12, admittedly, can also be obtained by the use of alkaline solutions. Usually, however, the pH is already adjusted to an alkaline value through the use of silicates, such as alkali silicates. Polysilicates are used to carry out exemplary embodiments 3 and 4. The solids content (solid material based on the total amount of aqueous solution) is 20% for lithium polysilicate, the use of which is preferred, 40% for sodium silicate and potassium silicate solutions (water glasses) and 20% for colloidal silicates. However, colloidal silicates with a solids content of up to 30% are also available and suitable. The molecular weight of lithium polysilicate is between 200 and 300 g/mole and, with that, is less than the molecular weight of the water glasses used. The silane used always comprises 100% solids.

TABLE 3

| Second Alkaline Passivation (Aqueous composition of polysilicate and silane) | | | | | | |
|---|---|---|---|---|---|---|
| Silane Component | Experiment No. | Lithium Polysilicate | Experiment No. | Sodium Water glass | Experiment No. | Colloidal Silicate |
| Methacryloxymethyl triethoxysilane | 1 | 0 | 14 | 0 | 27 | 0 |
| Methacryloxymethyl triethoxysilane | 2 | 15.2 | 15 | 1.3 | 28 | 27.8 |
| 3-Aminopropyl methyldiethoxysilane | 3 | 4.1 | 16 | 41.5 | 29 | 17.3 |
| 3-Aminopropyl tri-ethoxysilane | 4 | 7.5 | 17 | 33.2 | 30 | 47.5 |
| N-(2-Aminoethyl)-3-aminopropyl methyl-dimethoxysilane | 5 | 70.8 | 18 | 1.5 | 31 | 13.9 |
| 3-Glycidyloxypropyl trimethoxysilane | 6 | 19.3 | 19 | 2.9 | 32 | 28.9 |
| Vinyl trimethoxysilane | 7 | 5.9 | 20 | 70.2 | 33 | 55.5 |
| Vinyl triethoxysilane | 8 | 30.1 | 21 | 23.2 | 34 | 5.2 |
| Methyl trimethoxy-silane | 9 | 100.0 | 22 | 100.0 | 35 | 100.0 |
| Methyl trimethoxy-silane | 10 | 20.3 | 23 | 7.9 | 36 | 48.7 |
| 3-Mercaptopropyl trimethoxysilane | 11 | 7.5 | 24 | 21.3 | 37 | 2.3 |
| CoatOSil MP 200* | 12 | 27.5 | 25 | 3.9 | 38 | 45.0 |
| N-[3-(Trimethyloxysilyl) propyl] ethylenediamine | 13 | 25.6 | 26 | 9.2 | 39 | 44.1 |

*CoatOSil MP 200 is an oligomer of gamma glycidyl oxypropyl trimethoxysilane

Table 3 shows compositions for a second alkaline passivation, which, with the exception of two reference experiments with lithium polysilicate (Experiment No. 1) and methyl trimethoxysilane (Experiment No. 9), consists in each case of a silane-modified silicate. The numerical values in each case give the amount of silane used as a percentage by weight, based on the total composition of the silane and the silicate. It is supplemented with silicate to 100% by weight.

For example, an aqueous, alkaline composition for the manufacture of a second alkaline passivation, consisting of vinyl trimethoxysilane and lithium polysilicate (Experiment No. 7), comprises 5.9% by weight of silane and 94.1% by weight of lithium polysilicate (20% solids content). The aqueous, alkaline composition contains an amino-functional silane-modified lithium polysilicate here. An alternative second alkaline passivation is manufactured from an aqueous, alkaline composition containing vinyl trimethoxy silane and sodium water glass (Experiment No. 20); this aqueous, alkaline composition is composed of 70.2% by weight of silane and 29.8% by weight of silicate (40% solids content). The aqueous, alkaline composition therefore has a vinyl-functional silane-modified silicate here. Colloidal silicate, sodium water glass (sodium polysilicate) and lithium polysilicate are used, the latter being preferred. A completely hydrolyzed product is used, so that an essentially VOC-free application of the second alkaline passivation becomes possible.

The steel sheet, treated with the first, acidic passivation of exemplary embodiments 1 and 2, is dipped into the aqueous composition or coating liquid of a silane-modified silicate and subsequently dried, the same conditions being used as described for the manufacture of the first acidic passivation.

Alkaline, aqueous compositions which contain a silicate which is modified with different silanes are also very suitable as a second alkaline passivation. Table 4 shows such compositions, for which up to eight different silanes are used, in each case to modify a silicate.

The experiments in Tables 3 and 4 show that, for the silane-modified silicate, the proportions by weight of silane and silicate can be varied within a wide range. The proportion of silicate may vary between 1% by weight and 99% by weight; preferably, however, it is between 20% by weight, and 90% by weight. The silane can be used in the same amounts as the silicate; both are used in complementary proportions, so that they add up to 100% by weight for the formulations given here. Preferably, up to 20% by weight of silane is used. According to a particularly advantageous embodiment, lithium polysilicate and silane are used in a ratio of about 1:1, based on the solids content.

With the first, acidic passivation, very thin layers of up to 300 nm are applied; generally layers are up to 150 nm thick and preferably up to 100 nm. In spite of the low thickness of the layer, the inventive first passivation provides good protection against corrosion. The second alkaline passivation layer is applied in a thickness of up to 1 μm and advantageously of 10 nm to 500 nm. Preferably, the thickness of the second layer is 300 nm here.

TABLE 4

Second alkaline passivation
(aqueous composition of polysilicate and several silanes)

| | Experiment No. | | | | |
|---|---|---|---|---|---|
| | 40 | 41 | 42 | 43 | 44 |
| Silane Component | | | | | |
| Methacryloxy methyltriethoxysilane | 1.0% | 15.0% | 0.0% | 5.0% | 2.0% |
| 3-Aminopropyl methyldiethoxysilane | | | 5.0% | | 1.0% |
| 3-Aminopropyl triethoxysilane | | | | 1.3% | |
| N-(2-Aminoethyl)-3-aminopropyl methyldimethoxysilane | | | 15.0% | | |
| 3-Glycidyloxypropyl trimethoxysilane | 4.0% | 20.0% | | 21.0% | 5.0% |
| Vinyl trimethoxysilane | | 5.0% | 2.0% | 2.7% | 5.0% |
| Vinyl triethoxysilane | | | | | 1.5% |
| 3-Mercaptopropyl trimethoxysilane | | | | 5.0% | 3.0% |
| CoatOSil MP 200* | 5.0% | 25.0% | 2.0% | 5.0% | 45.0% |
| N-[3-(Trimethyloxysilyl) propyl] ethylenediamine | | 15.0% | 6.0% | 5.0% | 7.5% |
| Silicate Component, used as polysilicate respectively | | | | | |
| Lithium polysilicate | 90.0% | | | | |
| Sodium water glass | | | 70.0% | 55.0% | |
| Colloidal silicate | | 20.0% | | | 30.0% |

*CoatOSil MP 200 is an oligomer of gamma glycidyl oxypropyl trimethoxysilane

The aqueous composition for the second alkaline passivation was manufactured by the joint hydrolysis of the silanes or respectively siloxanes and the silicates, here polysilicates, and the subsequent removal of the alcohols released by means of vacuum distillation.

The compositions for the first, acidic passivation (Tables 1 and 2), which are described in Tables 1-4, and for the second, alkaline passivation (Tables 3 and 4) were applied on steel sheets consecutively, as explained above, in conjunction with the application of the first acidic passivation.

However, untreated steel sheets, as well as steel sheets which had been provided only with a first acidic passivation or only with a second passivation were also tested for comparison. These comparison objects and the steel sheets which had been provided with both the acidic and alkaline passivations according to the invention were then subjected to the neutral salt spray test, DIN EN ISO 9227. The results of this test are summarized in Table 5. All the steel sheets used for carrying out exemplary embodiments 1 to 4 have a zinc alloy surface.

Line 1 of Table 5 in each case shows the corrosion protection results for steel sheets which were tested with the first, acidic passivation, but without the second alkaline passivation. Column 1 of Table 5 shows steel sheets which were tested without the first, acidic passivation, but with the second, alkaline passivation. The experimental results in column 1 and line 1 show the results of testing a steel sheet without passivation.

Columns 1-12 of Table 5 in each case show the corrosion protection results for the aqueous compositions of the first, acidic passivation, listed in Tables 1 and 2. Lines 1-44 of Table 5 show the second, alkaline passivations in each case applied on these acidic passivations.

The compositions of the first, acidic passivation of Experiments 1, 5 and 7, were carried out without vanadium or tungsten compounds.

The results, shown in Table 5, were evaluated as follows:

-- no corrosion protection: residence time in the salt spray test <24 hours

- moderate corrosion protection: residence time in the salt spray test >24 hours.

O average corrosion protection:

residence time in the salt spray test >48 hours

+ good corrosion protection: residence time in the salt spray test >150 hours

++ outstanding corrosion protection residence time in the salt spray test >360 hours (white rust), residence time in the salt spray test >720 hours (red rust), In particular, if the first column in Table 5 is compared with the other columns, it is seen that, without the first, acidic passivation, an average corrosion protection can be attained at best, even with an otherwise very highly effective second, alkaline passivation. On the other hand, it can be seen that, for building up good or outstanding corrosion protection, the initial application of an acidic passivation, admittedly, is of importance; however, the quality of the measured corrosion protection of the inventive, two-layer passivation depends more on the composition of the second alkaline passivation. This is indicated by the fact that the results in a line (with the exception of the column "without") can all be classified identically.

Furthermore, it is seen that compositions for the second, alkaline passivation which contain silane-modified lithium polysilicate bring about predominantly outstanding corrosion protection if they are applied on an acidic passivation (Experiments 1-13 of the second passivation). Inventive acidic and alkaline passivations yield particularly good results if the acidic passivation contains vanadium, tungsten or the compounds thereof. However, also the aqueous alkaline compositions of a silicate, modified with several silanes, quite predominantly produce outstanding corrosion protection on the basis of an acidic passivation.

An alkaline passivation, for which colloidal silicate or water glass is used in combination with silane, that is, the silicate or water glass is silane-modified, and which is applied on an acidic passivation, leads to good and, in some cases, also outstanding results when checked by the neutral salt spray test.

TABLE 5

Results of the Corrosion Protection Test

| | | First Passivation Variation | | | | | | | | | | | | |
|---|---|---|---|---|---|---|---|---|---|---|---|---|---|---|
| | | without | 1 | 2 | 3 | 4 | 5 | 6 | 7 | 8 | 9 | 10 | 11 | 12 |
| Second Passivation Variation | without | — | − | ○ | ○ | ○ | ○ | ○ | − | ○ | ○ | ○ | ○ | ○ |
| | 1 | − | − | ○ | ○ | ○ | ○ | ○ | − | ○ | ○ | ○ | ○ | ○ |
| | 2 | ○ | ○ | ++ | ++ | ++ | ++ | ++ | ○ | ++ | ++ | ++ | ++ | ++ |
| | 3 | ○ | ○ | + | + | + | + | + | ○ | + | + | + | + | + |
| | 4 | ○ | ○ | + | + | + | + | + | ○ | + | + | + | + | + |
| | 5 | ○ | + | ++ | ++ | ++ | ++ | ++ | + | ++ | ++ | ++ | ++ | ++ |
| | 6 | ○ | + | ++ | ++ | ++ | ++ | ++ | + | ++ | ++ | ++ | ++ | ++ |
| | 7 | ○ | ○ | + | + | + | + | + | ○ | + | + | + | + | + |
| | 8 | ○ | + | ++ | ++ | ++ | ++ | ++ | + | ++ | ++ | ++ | ++ | ++ |
| | 9 | ○ | ○ | ○ | ○ | ○ | ○ | ○ | ○ | ○ | ○ | ○ | ○ | ○ |
| | 10 | ○ | ○ | + | + | + | + | + | ○ | + | + | + | + | + |
| | 11 | ○ | + | ++ | ++ | ++ | ++ | ++ | + | ++ | ++ | ++ | ++ | ++ |
| | 12 | ○ | + | ++ | ++ | ++ | ++ | ++ | + | ++ | ++ | ++ | ++ | ++ |
| | 13 | ○ | + | ++ | ++ | ++ | ++ | ++ | + | ++ | ++ | ++ | ++ | ++ |
| | 14 | − | − | ○ | ○ | ○ | ○ | ○ | − | ○ | ○ | ○ | ○ | ○ |
| | 15 | ○ | ○ | + | + | + | + | + | ○ | + | + | + | + | + |
| | 16 | ○ | ○ | + | + | + | + | + | ○ | + | + | + | + | + |
| | 17 | ○ | ○ | + | + | + | + | + | ○ | + | + | + | + | + |
| | 18 | ○ | − | + | + | + | + | + | − | + | + | + | + | + |
| | 19 | ○ | ○ | + | + | + | + | + | ○ | + | + | + | + | + |
| | 20 | ○ | + | ++ | ++ | ++ | ++ | ++ | + | ++ | ++ | ++ | ++ | ++ |
| | 21 | ○ | + | ++ | ++ | ++ | ++ | ++ | + | ++ | ++ | ++ | ++ | ++ |
| | 22 | ○ | − | ○ | ○ | ○ | ○ | ○ | − | ○ | ○ | ○ | ○ | ○ |
| | 23 | ○ | ○ | + | + | + | + | + | ○ | + | + | + | + | + |
| | 24 | ○ | + | ++ | ++ | ++ | ++ | ++ | + | ++ | ++ | ++ | ++ | ++ |
| | 25 | ○ | ○ | + | + | + | + | + | ○ | + | + | + | + | + |
| | 26 | ○ | + | ++ | ++ | ++ | ++ | ++ | + | ++ | ++ | ++ | ++ | ++ |
| | 27 | − | − | ○ | ○ | ○ | ○ | ○ | − | ○ | ○ | ○ | ○ | ○ |
| | 28 | ○ | + | ++ | ++ | ++ | ++ | ++ | + | ++ | ++ | ++ | ++ | ++ |
| | 29 | ○ | ○ | + | + | + | + | + | ○ | + | + | + | + | + |
| | 30 | ○ | + | ++ | ++ | ++ | ++ | ++ | + | ++ | ++ | ++ | ++ | ++ |
| | 31 | ○ | − | + | + | + | + | + | − | + | + | + | + | + |
| | 32 | ○ | + | ++ | ++ | ++ | ++ | ++ | + | ++ | ++ | ++ | ++ | ++ |
| | 33 | ○ | + | ++ | ++ | ++ | ++ | ++ | + | ++ | ++ | ++ | ++ | ++ |
| | 34 | ○ | ○ | + | + | + | + | + | ○ | + | + | + | + | + |
| | 35 | ○ | − | ○ | ○ | ○ | ○ | ○ | − | ○ | ○ | ○ | ○ | ○ |
| | 36 | ○ | ○ | + | + | + | + | + | ○ | + | + | + | + | + |
| | 37 | ○ | ○ | + | + | + | + | + | ○ | + | + | + | + | + |
| | 38 | ○ | + | ++ | ++ | ++ | ++ | ++ | + | ++ | ++ | ++ | ++ | ++ |
| | 39 | ○ | + | ++ | ++ | ++ | ++ | ++ | + | ++ | ++ | ++ | ++ | ++ |
| | 40 | ○ | ○ | + | + | + | + | + | ○ | + | + | + | + | + |
| | 41 | ○ | + | ++ | ++ | ++ | ++ | ++ | + | ++ | ++ | ++ | ++ | ++ |
| | 42 | ○ | ○ | ++ | ++ | ++ | ++ | ++ | ○ | ++ | ++ | ++ | ++ | ++ |
| | 43 | ○ | ○ | ++ | ++ | ++ | ++ | ++ | ○ | ++ | ++ | ++ | ++ | ++ |
| | 44 | ○ | ○ | ++ | ++ | ++ | ++ | ++ | ○ | ++ | ++ | ++ | ++ | ++ |

The corrosion resistance of steel sheets which are not provided or only provided with an acidic or an alkaline passivation, with a surface which is coated with a zinc-iron alloy, and also the corrosion resistance of steel sheets which have a zinc-iron alloy surface and, in accordance with the invention, are provided with a first acidic passivation and a second alkaline passivation, were tested in a neutral salt spray test, as explained above. A steel sheet with a surface of a zinc-iron alloy, however without any coating, shows a corrosion resistance of less than 24 hours (experiment column 1, line 1: −−). Steel sheets which are coated with a zinc-iron alloy and have received at least an acidic passivation (experiments of line 1) or which have received only an alkaline passivation (experiments of column 1), had a slight to average corrosion resistance in the salt spray test.

As a rule, steel sheets with a zinc-iron alloy surface, on which a first, acidic passivation as well as a second alkaline passivation having silane-modified silicates were applied, show at least a good and frequently, however, an excellent corrosion protection.

The results for the acidically passivated substrates, produced using vanadium and tungsten compounds (Experiments 2-4, 6, 8-12), which were then treated, in accordance with the invention with a second alkaline passivation, must be emphasized especially.

In evaluating the effect contributed by the second alkaline passivation to the corrosion protection, it is seen that the alkaline passivations with lithium polysilicate (experiments of lines 1-13) predominantly offer outstanding corrosion protection, especially when lithium polysilicate is modified with one or more silanes or siloxanes.

Colloidal silicates or respectively silica sols also lead to good, continued corrosion protection, especially if the colloidal silicates are modified in conjunction with silanes or siloxanes (experiments on lines 28-39; 41, 44). The same holds good for silicates, which were modified simultaneously in an admixture with several silanes or siloxanes. Predominantly outstanding results were achieved here in the salt spray test.

However, the water glasses also are very good for producing aqueous, alkaline passivating solutions; passivations which were manufactured with such solutions exhibit good corrosion protection results, especially if the silicates used were modified with silanes or siloxanes (Experiments 14-26; 42, 43).

It should be emphasized that these passivations, which offer good to outstanding corrosion protection, manage to do so without cobalt compounds and without chromium VI compounds. It should furthermore be emphasized that these acidic and alkaline passivations can be applied and dried essentially VOC-free, not least because completely hydrolyzed, silane-modified silicates, especially polysilicates, preferably are used.

Furthermore, it is seen that the effect of the second, alkaline passivation does not depend on the composition of the first, acidic passivation. Instead, it is seen that, with the combination of an acidic and alkaline passivation, good to very good corrosion protection can also be achieved even if, for example, few or no vanadium compounds or tungsten compounds or phosphonic acid are contained in the acidic passivation.

The invention claimed is:

1. A method for the manufacture of a metallic substrate, which is provided with a passivation which is free of chromium VI and cobalt, by applying a first acidic passivation and a second alkaline passivation on the metallic substrate, wherein, for the manufacture of the first, acidic passivation, an aqueous acidic composition is applied on the substrate, the composition containing a chromium(III) compound which is selected from the group consisting of chromium(III) sulfate, chromium(III) hydroxide, chromium(III) dihydrogen phosphate, chromium(III) chloride, chromium(III) nitrate, sodium chromium(III) sulfate, potassium chromium(III) sulfate and chromium (III) salts of organic acids, and a phosphonic acid and/or derivatives thereof in amounts of 0.5 to 3% by weight, based on the first acidic composition, and wherein, for the manufacture of the second alkaline passivation, an aqueous alkaline composition is used, which contains silane-modified and/or siloxane-modified silicates.

2. The method according to claim 1, wherein, with the second alkaline passivation, an aqueous alkaline composition is applied on the substrate, the composition comprising a silane-modified and/or a siloxane modified silicate with a 1% by weight up to a 99% by weight proportion of silane.

3. The method according to claim 1, wherein, for the manufacture of the second alkaline passivation, an aqueous, alkaline composition is applied on the metallic substrate, the composition containing one or more silicates from the group consisting of colloidal silica sols, sodium, potassium, lithium and ammonium silicate, all silicates in this case also comprising polysilicates.

4. The method according to claim 3, wherein, for the manufacture of the second alkaline passivation, an aqueous alkaline composition is applied which contains lithium polysilicate or a mixture of lithium polysilicate with colloidal silica sols, sodium, potassium and/or ammonium silicate.

5. The method according to claim 1, wherein the aqueous alkaline composition applied for the manufacture of the second alkaline passivation contains a vinyl-, amino- or epoxy-functional silane and/or a siloxane or a mixture of these silanes or siloxanes.

6. The method according to claim 5, wherein the aqueous solution applied for the manufacture of the second alkaline passivation contains one or more silanes from the group consisting of methacryloxy methyltriethoxy silane, 3-aminopropyl methyldiethoxy silane, 3-aminopropyl triethoxy silane, N-(2-aminoethyl) 3-aminopropyl methyldimethoxy silane, 3-glycidyloxy propyltrimethoxy silane, vinyl trimethoxy silane, vinyl triethoxy silane, methyl trimethoxy silane, ethyl trimethoxy silane, as well as 3-mercaptopropyl trimethoxy silane and siloxanes.

7. The method according to claim 1, wherein the aqueous alkaline composition used for the manufacture of the second alkaline passivation contains silicates, silanes, siloxanes and silane-modified and/or siloxane-modified silicates which are used in a partly or completely hydrolyzed form.

8. The method according to claim 1, wherein a substrate is coated which has a metallic surface from the group consisting of a surface of zinc, aluminum, a zinc-aluminum alloy, a zinc-iron alloy or an alloy of zinc or aluminum with one or more other metals.

9. The method according to claim 1, wherein the second alkaline passivation has a layer thickness of 10 nm to 1 μm.

10. The method according to claim 1, wherein a first, acidic passivation is applied, which is subsequently dried and wherein a second alkaline passivation is applied on the dried, first passivation.

11. The method according to claim 1, wherein, for the manufacture of the first, acidic passivation, an aqueous acidic composition is applied on the substrate, the composition containing a nitrate compound.

12. The method according to claim 1, wherein, for the manufacture of the first, acidic passivation, an aqueous acidic composition is applied on the substrate, the composition containing a source of fluorine, wherein, as source of fluorine, a compound is selected from the group consisting of hydrofluoric acid, hexafluorotitanic acid, hexafluorozirconic acid, sodium fluoride, potassium fluoride, ammonium fluoride, sodium bifluoride, potassium bifluoride and ammonium bifluoride.

13. The method according to claim 1, wherein, for the manufacture of the first, acidic passivation, an aqueous, acidic composition is applied on the substrate, the composition containing one or more of the compounds of the metals molybdenum, vanadium or tungsten.

14. The method according to claim 1, wherein, for the manufacture of the first, acidic passivation, an aqueous, acidic composition is applied on the substrate, the composition containing one or more of the compounds from the group consisting of potassium molybdate, sodium molybdate, potassium orthovanadate, potassium metavanadate, sodium orthovanadate, sodium metavanadate, sodium tungstate, sodium paratungstate and vanadium pentoxide.

15. The method according to claim 1, wherein, for the manufacture of the first acidic passivation, an aqueous composition is applied on the substrate, for which one or more acids are used from the group consisting of (1-hydroxyethane-1,1-diyl) biphosphonic acid, 2-phosphonobutane-1,2,4-tricarboxylic acid, aminotrimethylene phosphonic acid, ethylene diamine tetramethylene phosphonic acid and diethylene triamine pentamethylene phosphonic acid.

16. The method according to claim 1, wherein, for the manufacture of the first, acidic passivation, an aqueous, acidic composition is applied on the substrate, the composition containing phosphonates individually or in a mixture from the group consisting of tetrasodium (1-hydroxyethane-1,1-diyl) biphosphonate, trisodium (1-hydroxyethane-1,1-diyl) biphosphonate, pentasodium ethylenediamine tetramethylene phosphonate and heptasodium diethylenetriamine pentamethylene phosphonate.

17. The method according to claim 1, wherein, for the manufacture of the first acidic passivation, an aqueous acidic composition is applied on the substrate, the composition containing one or more of the elements or the compounds thereof of the group consisting of molybdenum, manganese, cerium, lanthanum.

18. The method according to claim 1, wherein the first acidic passivation has a layer thickness of 10 nm to 1 μm.

19. The method according to claim 18, wherein the layer thickness is up to 500 nm.

* * * * *